US005095674A

United States Patent [19]

Huettemann

[11] Patent Number: 5,095,674

[45] Date of Patent: Mar. 17, 1992

[54] CONCRETE BUILDING PANEL WITH INTERMESHED INTERIOR INSULATING SLAB AND METHOD OF PREPARING THE SAME

[76] Inventor: Erik W. Huettemann, 285 Mill Rd., Madison, Ala. 35758

[21] Appl. No.: 516,467

[22] Filed: Apr. 30, 1990

Related U.S. Application Data

[63] Continuation-in-part of Ser. No. 371,915, Jun. 27, 1989, Pat. No. 4,942,707, which is a continuation-in-part of Ser. No. 158,476, Feb. 22, 1988, Pat. No. 4,841,702.

[51] Int. Cl.[5] ..... E04B 1/60; E04D 11/02

[52] U.S. Cl. ..... 52/407; 52/309.11; 52/743; 52/612; 264/34; 264/35; 264/46.6

[58] Field of Search ..... 52/743, 744, 309.4, 52/309.11, 309.12, 612, 334, 336, 259; 428/116, 117, 316.6; 264/251, 256, 34, 35, 250, 259, 46.6

[56] References Cited

U.S. PATENT DOCUMENTS

| | | | |
|---|---|---|---|
| 526,730 | 10/1894 | Norcross | 52/453 |
| 1,178,210 | 4/1916 | Brinckerhoff | 52/336 |
| 3,000,144 | 9/1961 | Kitson | 52/309.11 |
| 3,211,601 | 10/1965 | Wand et al. | 428/117 |
| 3,295,278 | 1/1967 | Muhm | 52/612 |
| 3,512,327 | 5/1970 | Padura | 52/309.12 |
| 3,653,170 | 4/1972 | Scheckler | 52/309.12 |
| 3,841,958 | 10/1974 | Delorme | 52/309.11 |
| 3,857,217 | 12/1974 | Reps | 52/589 |
| 4,288,956 | 9/1981 | Heck | 52/743 |

FOREIGN PATENT DOCUMENTS

| | | | |
|---|---|---|---|
| 455517 | 2/1928 | Fed. Rep. of Germany | 264/256 |
| 2128251 | 12/1972 | Fed. Rep. of Germany | 52/309.4 |
| 1135877 | 1/1985 | U.S.S.R. | 52/630 |

*Primary Examiner*—James L. Ridgill, Jr.
*Attorney, Agent, or Firm*—Phillips & Beumer

[57] ABSTRACT

An insulated concrete building panel having an internal slab of insulating material, layers of concrete on each of the slab faces, and a concrete frame around its edges. One face of the slab has a pattern of grooves into which concrete is cast to provide ribs that are cast integral with the outer layer on that face. The other face has ridges, preferably of trapezoidal cross section that, when placed upon a bottom layer of cast but uncured concrete, become intermeshed with the bottom layer. The panels are prepared by first casting a layer of concrete on a horizontal surface, placing the slab, grooved face up, on the cast but uncured layer, and casting concrete over the grooved face, into the grooves and around the slab edges. Panels having this structure are useful for constructing buildings such as warehouses where long panel lengths of concrete inner face and internal insulation are needed.

11 Claims, 4 Drawing Sheets

CONCRETE BUILDING PANEL WITH INTERMESHED INTERIOR INSULATING SLAB AND METHOD OF PREPARING THE SAME

CROSS REFERENCE TO RELATED APPLICATION

This application is a continuation-in-part of pending application Ser. No. 071,371,915, filed June 27, 1989, now U.S. Pat. NO. 4,942,707, issued July 24, 1990, which patent is a continuation-in-part of Ser. No. 158,476, filed Feb. 22, 1988, now U.S. Pat. No. 4,841,702, issued June 27, 1989.

TECHNICAL FIELD

This invention relates generally to building panels and more particularly to precast, insulated concrete building panels.

BACKGROUND OF THE INVENTION

Precast concrete building panels provide advantages for many applications in that construction time and forming requirements for preparation of panels are reduced. Such panels may be prepared by casting them in a suitable mold on a horizontal surface, preferably an already cast floor slab at the construction site. Upon curing, the cast panels are then erected into final position by means of a crane using "tilt-up" construction techniques. My prior patent, U.S. Pat. No. 4,871,702, issued June 27, 1989, discloses precast panels that include a rigid internal slab of insulating material, the panels being formed by providing grooves in an upper face of the slab, placing its lower face over a layer of particle board or the like, and pouring concrete to provide a layer over the upper face and into forms around the edges of the slab. Concrete poured into the grooves forms supporting ribs which, together with the concrete edge frames, give the panels necessary strength.

Panels adapted for use in ceilings or roofs are disclosed in my co-pending application Ser. No. 071,371,915, filed June 27, 1989. These panels are generally similar to those described above except that the panels which are to be disposed adjacent to one another at interior locations away from the ceiling or roof edge do not have precast edge frames at such locations. Edges without edge frames are sealably joined together after being placed in an array.

Requirements exist for insulated concrete panels that would have concrete layers on both faces of an insulating slab instead of only one face, as is the case for the panels described above. Concrete faced interior wall surfaces may be preferred over wood faced surfaces for applications such as warehouses and industrial buildings. Panels for walls of these buildings are often needed in long lengths such as 24 feet or more, and the additional strength that would be provided by another layer of concrete as well as by internal ribs in grooves in the slab on one face and concrete intermeshed with slab ridges on the other face would enhance the capability of long-span panels to be lifted and guided into position without breaking. In addition, high strength such as to provide the panels with load-bearing capability may be desired.

SUMMARY OF THE INVENTION

This invention is directed to building panels having an internal slab of insulating material, layers of concrete on each of the slab faces, and a concrete frame around its edges. A first face of the slab has grooves into which concrete is cast integral with the outer layer on that face, providing supporting ribs for the panel. The opposite face of the insulating slab has protruding ridge intermeshed with the adjacent concrete layer on that panel face. Panels having this structure can be prepared by providing a slab of insulating material having a pattern of grooves on one of its faces and ridges, preferably having a trapezoidal cross section, on its opposite face, casting a layer of concrete on a horizontal surface, placing the slab, groove-side up, onto the cast layer while in uncured condition, providing edge forms spaced apart from the edges of the panels and casting concrete over the top surface of the slab, into the groove and around the slab edges. The weight of the upper concrete layer forces the ridges on the bottom the slab to be moved downward into the uncured lower layer so that the ridges become intermeshed with the lower layer, and the bottom surface of the slab at locations between ridges is forced into flush contact with the bottom concrete layer. This provides a panel having integrally cast concrete faces with ribs disposed in grooves of the slab in one face and concrete intermeshed with ridges of the slab at its other face, along with edge frames around the periphery of the panel. Reinforcing means such as bars and/or wire mesh and screws disposed in the slab grooves and extending through the ridges may be incorporated in the panels as desired.

Panels embodying the invention exhibit a high insulating value and provide interior as well as outer surface layers of concrete as may be required for certain types of buildings. In particular, this panel structure is useful for warehouses or plants where an interior concrete surface is desired for rough conditions of usage where wooden surfaces would become damaged. Sufficient strength is provided to facilitate handling and erection of long-span panels, and load-bearing capability may also be provided to the panels as desired.

It is, therefore, an object of this invention to provide insulating concrete panels that have an interior as well as an exterior layer of concrete.

Another object is to provide long lengths insulated concrete panels having sufficient strength for handling and erection.

Another object is to provide a method of preparing such panels.

Other objects and advantages of the invention will be apparent from the following detailed description.

DESCRIPTION OF THE PREFERRED EMBODIMENT

Figure 2:
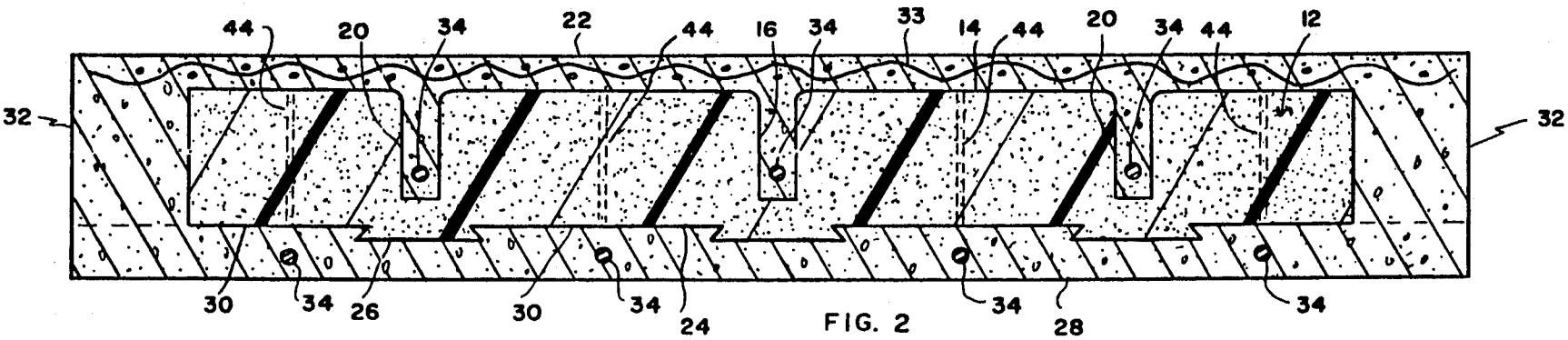
FIG. 2 is a sectional view taken along line 2—2 of FIG. 1.
Figure 1:
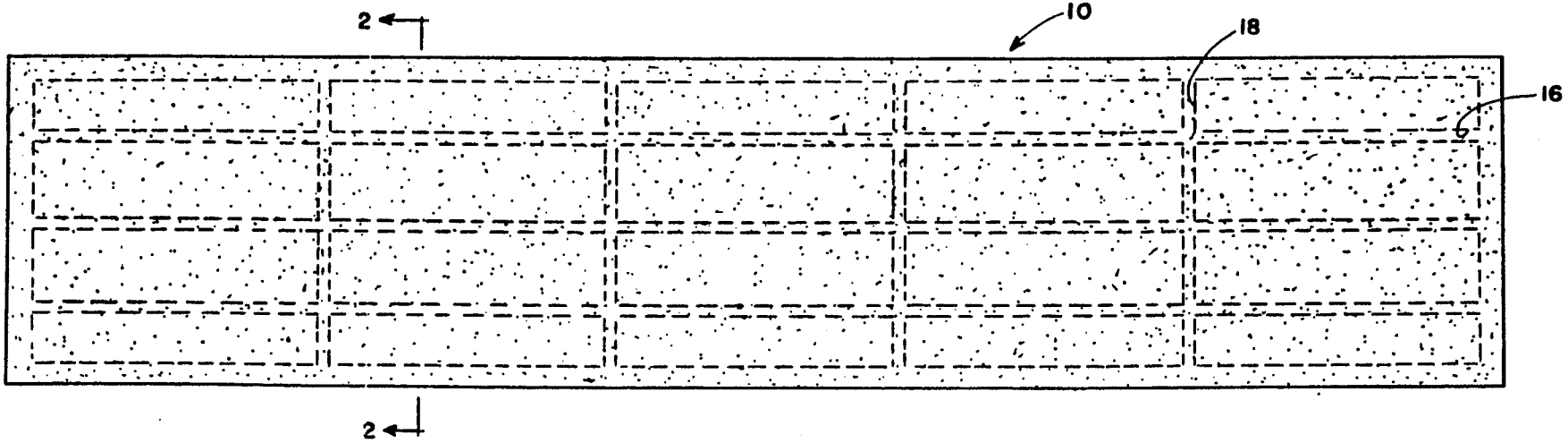
FIG. 1 is a plan view of an elongated wall panel embodying the invention with internal features shown in dotted lines.
Figure 3:
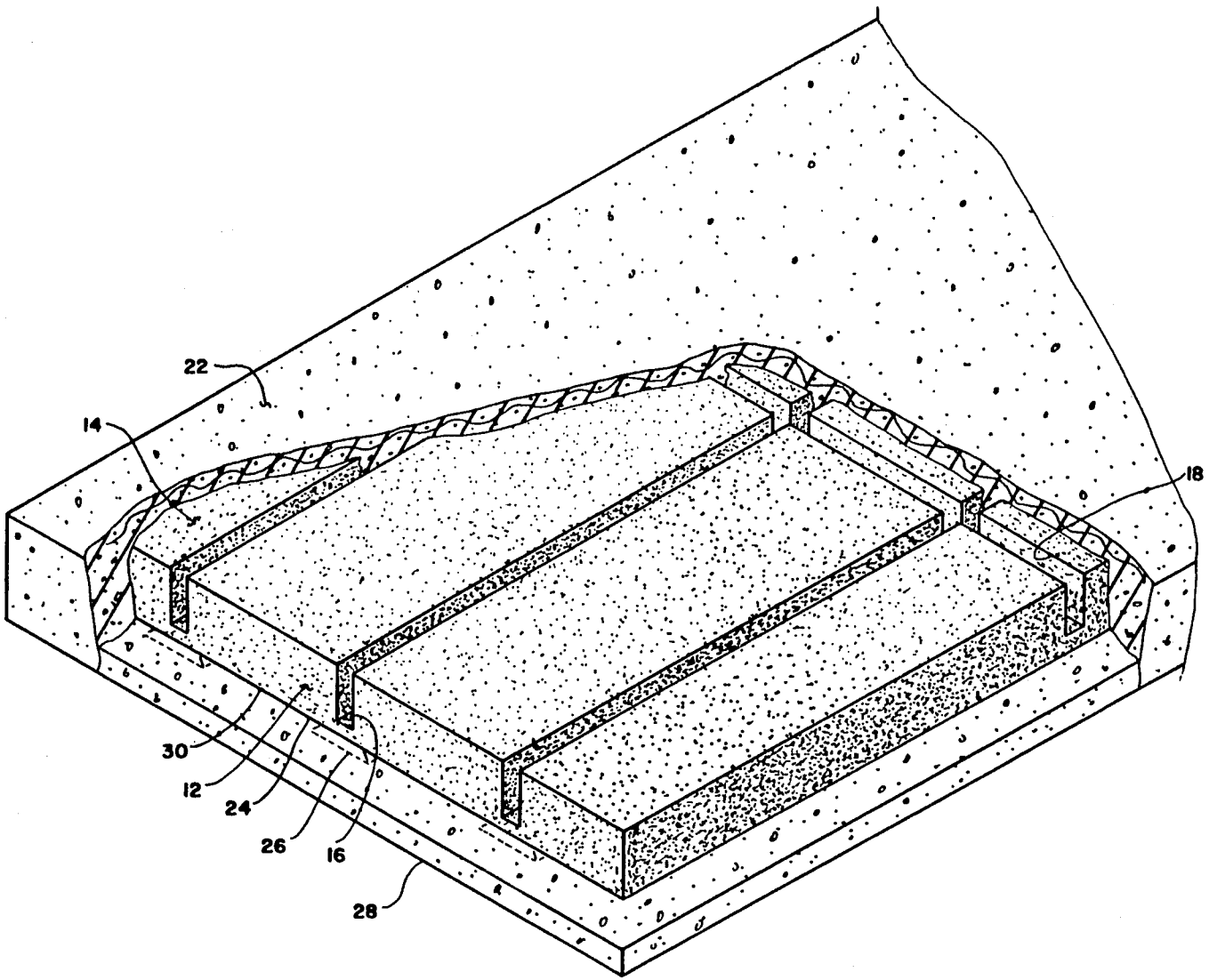
FIG. 3 is a pictorial view of an end portion of the panel with parts broken away.

Referring to FIGS. 1, 2, and 3 of the drawings, there is shown a rectangular insulated concrete wall panel 10 embodying the invention. The panel includes an interior slab 12 of insulating material which may comprise a rigid block of expanded polystyrene. The upper face 14 of the insulated slab has formed therein a pattern of longitudinal grooves 16 and transverse grooves 18 into which concrete ribs 20 are cast integral with an upper layer 22 of concrete covering the top of the slab. Lower face 24 of the slab has opposite from and underneath longitudinal grooves 16, ridges 26 of trapezoidal cross section extending outward from the slab face. Ridges 26 are embedded in and intermeshed with bottom concrete layer 28 which covers the lower face of the panel. Areas 30 of the bottom surface of the slab between ridges are disposed flush with the upper surface of concrete layer 28. Concrete edge frames 32 are disposed around the side edges of the panel and are cast integrally with the top concrete layer and ribs. Reinforcing wire 33 and bars 34 are provided in the cast concrete as required to provide the desired strength.

Figure 4:
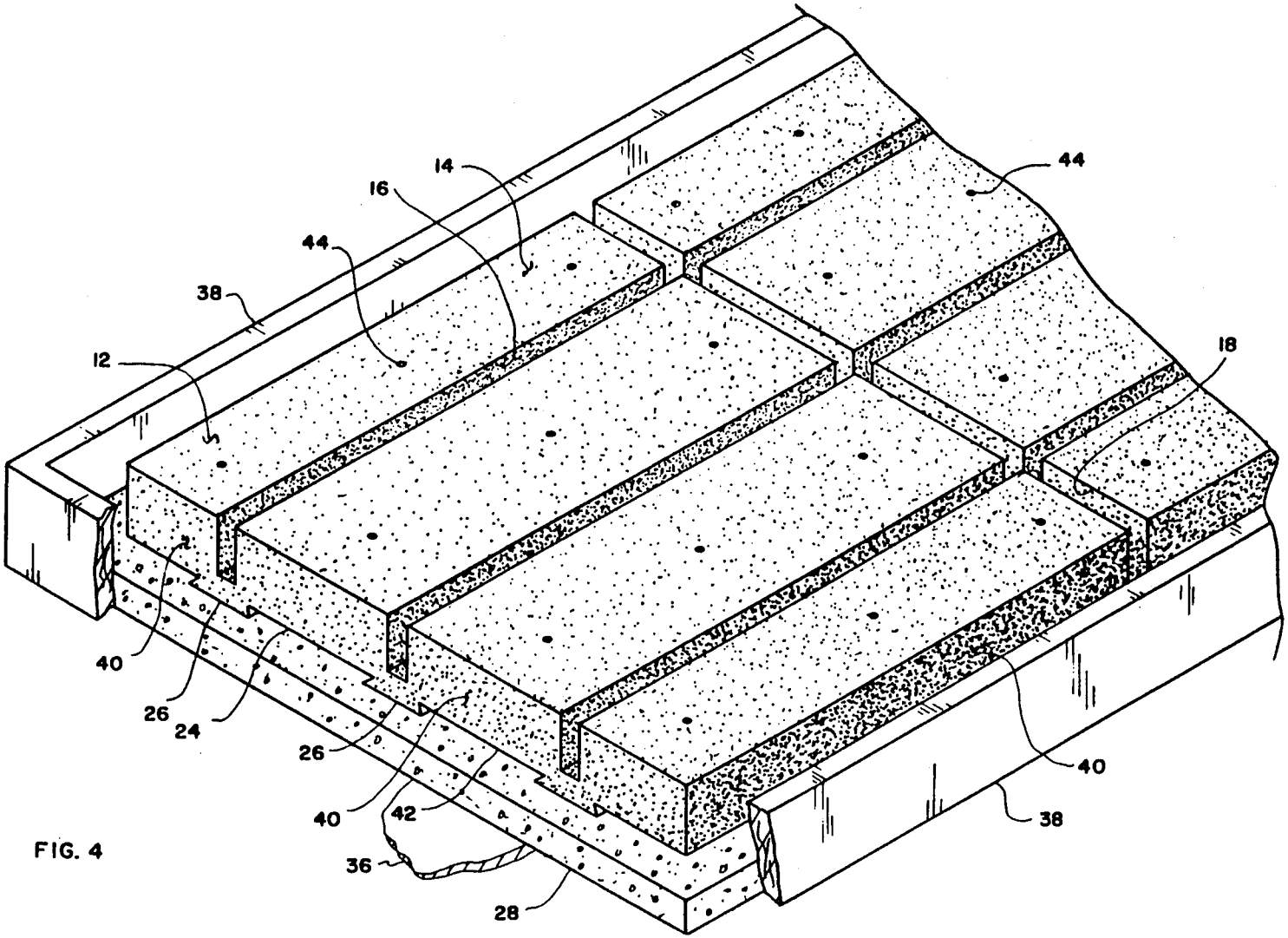
FIG. 4 is a pictorial view of a panel at an intermediate stage of preparation.

FIG. 4 shows a panel at an intermediate stage of preparation and illustrates a method by means of which panels embodying the invention may be prepared. In this view, lower concrete layer 28 is shown cast onto an underlying floor surface 36 but uncured, the layer being restrained at panel edge locations by vertically disposed forms 38 spaced apart from edges 40 of the insulating slab 12. Ridges 26 on the lower face of the slab initially are supported on the upper surface of concrete layer 28, leaving a void space 42 between layer 28 and the areas 30 of slab face 24 between ridges. Upon casting of concrete over slab face 14, into grooves 16 and 18 and into the space between forms 38 and slab edges 40, the weight of the concrete being cast uniformly forces the slab downward so that the ridges move into the lower layer 28 and become intermeshed therewith. Areas 30 between ridges are then forced into flush contact with the upper surface of layer 28. To enable removal of air from void spaces 42 in this step, air holes 44 penetrating the slab at appropriate intervals may be provided.

Figure 5:
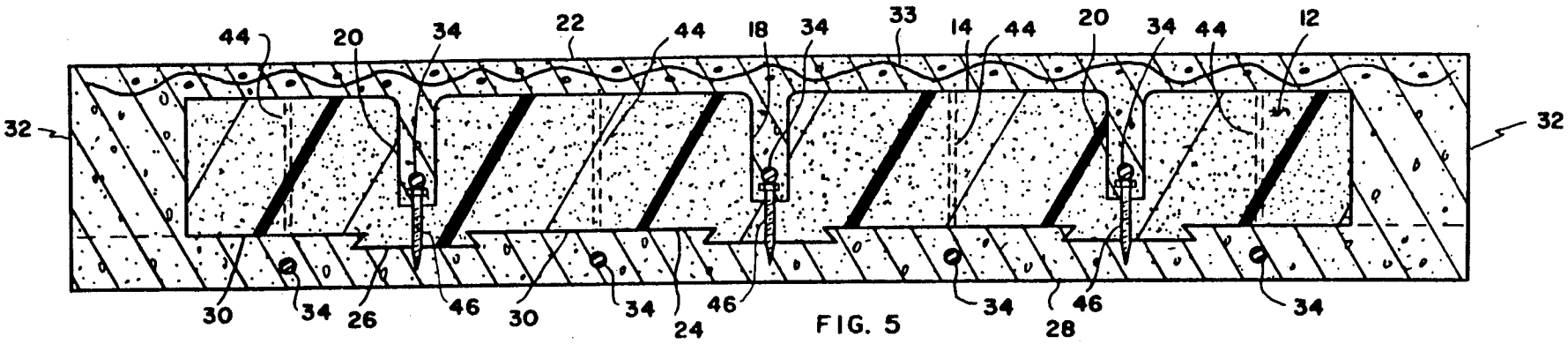
FIG. 5 is a cut-away view of an alternate embodiment including screws extending through the insulating slab.

FIG. 5 shows an embodiment wherein connecting pins in the form of screws 46 are disposed in grooves 18, extending through slab 12 and projecting downward from slab ridges 26. The screws serve to further tie the bottom concrete layer and ridged slab surface together and thus provide additional strength. As shown in the drawing, heads of the screws may also provide supports for holding reinforcing bars 34 in position during casting, thus simplifying lay-up procedures for casting. Nails, bolts, or the like may also be used in place of screws.

Panels embodying the invention provide additional strength over panels having only one concrete face, with strength being determined by the dimension from the grooved face to rebars in the bottom layer. Rebars in the bottom layer may be placed to take the tension to which the panels are exposed while being erected and to decrease deflection under lateral load. Rebars in the grooves are also placed to decrease deflection, but they also perform another important function, and that is of keeping the panels from collapsing in case of fire owing to their being in a well-insulated position.

Deflection of panels by a lateral load such as wind or seismic forces is an important factor in designing a panel for specific building applications; for example, certain building codes allow a deflection of 1/150th of the unsupported height of the panel. For long-span panels, measures which may be employed to meet such a requirement include increasing the strength of the bottom layer reinforcement by using stronger rebars, decreasing the distance between ribs in the grooved panel layer and using stronger rebars in the ribs, and increasing the thickness of the panel by increasing the thickness of the insulating slab but not the concrete face layers. This provides increased strength with minimized increase in weight. Increases in strength decrease deflection while increases in weight result in increased deflection; thus, this ability to decrease deflection by using a thicker insulating slab is an important advantage of the invention over prior tilt-up panels where such adjustment of panel structure was not possible.

Another advantage of panels embodying the invention is that they may be constructed with sufficient strength to enable them to be lifted by a crane by hooking onto panel lifting inserts located at only one end of the panel without breaking the panel. Prior tilt-up panels generally require attachment to several inserts spanning the middle of the panel to avoid breakage, and a time-consuming and expensive rigging procedure is employed to balance and lift the panels by such procedure.

While the invention is described above in terms of specific embodiments, it is not to be understood as so limited, but is limited only as indicated by the appended claims.

I claim:

1. An insulating building panel comprising:
an elongated, generally rectangular slab of insulating material having a first face and a second face;
said first face including grooves extending substantially into the surface of the slab;
said second face including ridges extending outwardly therefrom;
a first concrete layer covering said ridged face and having said ridges embedded therein;
a second concrete layer cast over said grooved face and into said grooves, providing supporting ribs and an outer layer; and
concrete edge frames disposed around the periphery of said slab and cast integrally with said second concrete layer.

2. A panel as defined in claim 1 wherein said grooves include longitudinal grooves and transverse grooves, each disposed at spaced-apart intervals.

3. A panel as defined in claim 2 wherein said ridges are located directly opposite said longitudinal grooves.

4. A panel as defined in claim 3 wherein said ridges have a trapezoidal cross section.

5. A panel as defined in claim 3 including connecting pins extending through said slab and projecting into said grooves and past said ridges into said first concrete layer.

6. A panel as defined in claim 5 wherein said connecting pins comprise headed screws having their heads spaced apart from the bottom of said groove.

7. A panel as defined in claim 1 including reinforcing means disposed within said concrete layers and said ribs.

8. A panel as defined in claim 6 including reinforcing bars disposed longitudinally in said ribs in contract with said screw heads.

9. A method of preparing an insulated concrete building panel which comprises:
providing a generally rectangular slab of insulating material;
forming grooves in one face of said slab and ridges projecting outward from the opposite face thereof;
casting a layer of concrete on a horizontal surface;

disposing said slab with its ridged face down in contact with said cast layer and prior to curing thereof;

providing forms spaced apart from edges of said slab;

casting concrete into said grooves, over said grooved face, and between said forms and said slab edges, whereby said ridges are forced into said concrete layer nd an upper layer and edge frames are provided; and curing the resulting cast concrete.

10. A method as defined in claim 9 including the step of inserting pin connecting means through said slab within said grooves so as to provide upper ends thereof projecting into said grooves and lower ends thereof projecting into said layer cast on a horizontal surface.

11. A method as defined in claim 10 including the step of placing rebars in said grooves in contact with upper ends of said pin connecting means.

* * * * *